United States Patent [19]

Bernasconi et al.

[11] Patent Number: 4,610,696

[45] Date of Patent: Sep. 9, 1986

[54] PROCESS FOR THE FORMATION OF HOMOGENEOUS FUEL COMPOSITIONS CONTAINING A PETROLEUM CUT AND AT LEAST ONE SHORT CHAIN ALIPHATIC ALCOHOL AND COMPOSITIONS THEREBY OBTAINED

[75] Inventors: Christian Bernasconi, Vernaison; Michel Llinares, Saint Genis Laval; Robert Nouguier, Plan de Cuques, all of France

[73] Assignee: Elf France, Paris, France

[21] Appl. No.: 750,548

[22] Filed: Jul. 1, 1985

[30] Foreign Application Priority Data

Jul. 3, 1984 [FR] France ..... 84 10545

[51] Int. Cl.[4] ..... C10L 1/02

[52] U.S. Cl. ..... 44/56; 44/53; 44/77

[58] Field of Search ..... 44/53, 56, 77

[56] References Cited

U.S. PATENT DOCUMENTS

| | | | |
|---|---|---|---|
| 2,087,582 | 7/1937 | Schneider | 44/56 |
| 2,104,021 | 1/1938 | Callis | 44/56 |
| 2,265,196 | 9/1941 | Riley | 44/53 |
| 2,774,656 | 12/1956 | Newman et al. | 44/53 |
| 3,474,151 | 10/1969 | Grane | 44/56 |

*Primary Examiner*—Mrs. Y. Harris-Smith

*Attorney, Agent, or Firm*—Burgess, Ryan & Wayne

[57] ABSTRACT

The present invention concerns a process for the formation of homogeneous fuel compositions containing a petroleum cut and at least one short chain aliphatic alcohol, essentially methanol, ethanol and the butanols, through dilution with an additive constituted by a $C_6$ to $C_{24}$ glycerol monoether.

8 Claims, No Drawings

PROCESS FOR THE FORMATION OF HOMOGENEOUS FUEL COMPOSITIONS CONTAINING A PETROLEUM CUT AND AT LEAST ONE SHORT CHAIN ALIPHATIC ALCOHOL AND COMPOSITIONS THEREBY OBTAINED

BACKGROUND OF THE INVENTION

The present invention concerns a process for the formation of homogeneous fuel compositions containing a petroleum fraction or cut and at least one short-chain aliphatic alcohol, essentially methanol, ethanol and the butanols and compositions obtained therefrom.

Short-chain alcohols are produced either from the fermentation of agricultural products or from the transformation of petrochemical residues. In both cases, their obtention is economically worthwhile.

Since alcohols are very hygroscopic substances, the fuel and alcohol mixtures always contain variable quantities of water. This water can originate during manufacture of the alcohols or simply from the humidity in the air or in the tank bottoms.

Fuel-alcohol-water ternary mixtures are unstable. They have a tendency to separate into two phases that increases with temperature drop.

Different methods have been proposed in order to maintain these mixtures in a homogeneous state.

Therefore, U.S. Pat. No. 4,261,702 in the name of TEXACO describes the drying of a fuel containing an alcohol at 95% purity. After separation of the fuel into two phases, a cetal, an acetal or an orthoester in an acid medium is added to the water-rich phase. These former compounds react with the water, and the thus dehydrated product is added to the remainder of the fuel.

According to German patent application No. 3 039 225 in the name of HOECHST, the addition of 0.05 to 5% of a borate prevents the separation into two phases of a mixture of gasoline and alcohols.

it is also known that the straight chain primary alcohols, such as 1-butanol, 1-pentanol or 1-hexanol decrease the separation temperature of these mixtures.

However, none of these additives allow the maintenance of homogeneous fuels at sufficiently low temperatures.

The aim of the present invention is to provide a process that allows maintaining homogeneous fuels containing a mixture of a petroleum cut and at least one alcohol, even at very low temperatures.

The process according to the invention consists in adding to the mixtures of petroleum cut and at least one alcohol, an additive constituted of a glycerol monoether.

The glycerol monoethers have one of the following general formulae:

$$\begin{array}{l} CH_2{-}OR \text{ or} \\ | \\ CH{-}OH \\ | \\ CH_2{-}OH \end{array} \qquad (I)$$

$$\begin{array}{l} CH_2{-}OH \\ | \\ CH{-}OR \\ | \\ CH_2{-}OH \end{array} \qquad (II)$$

in which R represents a $C_6$ to $C_{24}$ and preferably a $C_8$ to $C_{14}$ linear or branched aliphatic radical.

The molecule of these ethers contains a hydrophilic portion and a lipophilic portion which thus allows the said molecule to render compatible the pure hydrocarbonated phase containing a petroleum cut and the polar phase containing the alcohol and the water.

The compounds having the general formula (1) that contain two vicinal OH groups are more effective and allow a greater reduction in the separation temperature.

This phenomenon can be explained by the fact that a synergistic effect is created between the two vicinal hydroxyl groups, that form hydrogen links with the alcohol and water hydroxyl groups, thereby preventing the formation of a water-alcohol polar phase.

The quantities of additives used range from 0.5 to 15 kg/m$^3$ of fuel comprising a petroleum cut and at least one alcohol, and preferably between 4 and 6 kg/m$^3$.

The additives used are glycerol monoethers, the etherification being carried out with $C_6$ to $C_{24}$ and preferably with $C_8$ to $C_{14}$ linear or branched alcohols. Instead of using pure alcohols, it is also possible to carry out the etherification with alcohols cuts having a natural or synthetic origin. Among the additives used can be cited 1-dodecylglycerol and 2-dodecylglycerol.

The fuel compositions containing a petroleum cut, at least one short-chain alcohol and an additive according to the invention remain homogeneous, even at very low temperatures.

The petroleum cuts are those normally used as automobile fuels or super-fuels.

The alcohols used are short-chain alcohols such as methanol, ethanol and tertiobutanol or their mixtures. The fuel can contain variable quantities of alcohol, for example, between 3 and 10%.

EXAMPLES

Tests were carried out with a fuel of the following composition:

| | % volume |
|---|---|
| hydrocarbon cut | 94.9 |
| methanol | 3 |
| tertiobutanol | 2 |
| water | 0.1 |

The quantities of additives utilized are 500 mg per 100 ml fuel. The fuel whether diluted or not is placed in graduated tronconic flasks, which are then placed in a thermostatically-controlled bath. They are thereafter cooled until clouding occurs. The temperature thus corresponds to the separation temperature which is indicated in the table herein-below, which compiles a summary of the results of the experiments, without additive and with different additives.

| Additive | Separation temperature °C. |
|---|---|
| without | +10.5 |
| n-butanol-1 | −4.0 |
| n-pentanol-1 | −5.5 |
| n-hexanol | 0 |
| 2-O—dodecylglycerol | −5.0 |
| 1-O—dodecylglycerol | −11.0 |

We claim:

1. Process for maintaining homogeneous fuels comprising an automobile fuel and at least one short-chain aliphatic alcohol through dilution with an additive, wherein the additive is a glycerol monoether having one of the general formulae:

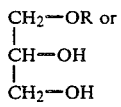

(I)

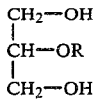

(II)

in which R represents a $C_6$ to $C_{24}$ linear or branched aliphatic radical and wherein the additive is used in quantities of between 0.5 and 15 $kgm^3$ of fuel.

2. Process according to claim 1, wherein R represents a $C_8$ to $C_{14}$ linear or branched aliphatic radical.

3. Process according to claim 1 or 2, wherein R represents a $C_{12}$ linear or branched aliphatic radical.

4. Process according to claim 1, wherein the additive is 1-dodecylglycerol.

5. Process according to claim 1, wherein said fuels contain tertiarybutanol.

6. Process according to claim 5, wherein said fuels further contain at least a compound selected from the group consisting of methanol and ethanol.

7. Process according to claim 1, wherein the additive is used in quantities of between 4 and 6 $kg/m^3$.

8. Homogeneous fuel composition containing an automobile fuel, at least one short-chain aliphatic alcohol and an additive, wherein the additive is a glycerol monoether having one of the general formulae:

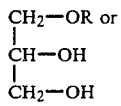

(I)

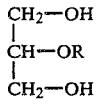

(II)

in which R represents a $C_6$ to $C_{24}$ linear or branched aliphatic radical and wherein the additive is used in quantities of between 0.5 and 15 $kgm^3$ of fuel.

* * * * *